United States Patent [19]

Frantl et al.

[11] Patent Number: 4,822,198

[45] Date of Patent: Apr. 18, 1989

[54] JOINT CONNECTION FOR FRAME STRUCTURES

[75] Inventors: Erich Frantl; Peter Hofstätter; Willibald Zemler; Albert P. Raunicher; Werner Frantl, all of Vienna, Austria

[73] Assignee: Dipl. -Ing. Manfred Beer, Mödling, Austria

[21] Appl. No.: 2,900

[22] Filed: Jan. 13, 1987

[30] Foreign Application Priority Data

Jan. 14, 1986 [AT] Austria ..... 68/86

[51] Int. Cl.[4] ..... F16B 7/04

[52] U.S. Cl. ..... 403/170; 403/218; 403/268; 403/277

[58] Field of Search ..... 403/266, 268, 267, 277, 403/170, 171, 172, 176, 248, 253, 263, 245, 361, 218, 217

[56] References Cited

U.S. PATENT DOCUMENTS

| | | | |
|---|---|---|---|
| 3,713,677 | 1/1973 | Du Preez | 403/409.1 X |
| 4,011,020 | 3/1977 | Frantl et al. | 403/268 X |
| 4,101,730 | 7/1978 | Netzel | 403/277 X |
| 4,280,769 | 7/1981 | Ceglowski | 403/171 X |
| 4,355,918 | 10/1982 | Van Vliet | 403/170 |

FOREIGN PATENT DOCUMENTS

| | | | |
|---|---|---|---|
| 822899 | 7/1949 | Fed. Rep. of Germany . | |
| 2362592 | 6/1975 | Fed. Rep. of Germany | 403/170 |
| 2615796 | 10/1977 | Fed. Rep. of Germany | 403/171 |
| 380236 | 7/1907 | France | 403/281 |
| WO82/00863 | 3/1982 | PCT Int'l Appl. . | |

*Primary Examiner*—Randolph A. Reese
*Assistant Examiner*—Peter M. Cuomo
*Attorney, Agent, or Firm*—Beveridge, DeGrandi & Weilacher

[57] ABSTRACT

In a joint including a plurality of bars linked thereby, the ends of the bars are inserted through apertures in a metal casing which is filled with a hardening grout. The ends of the bars received in the casing have necked-down portions having two tapered members therein which are oriented with their tapering sections facing in opposition and which are pretensioned toward each other by a tensioning member to contact the walls of the necked down portion in flatwise abutting engagement, in opposite sections of the necked down portion.

3 Claims, 1 Drawing Sheet

Fig.1
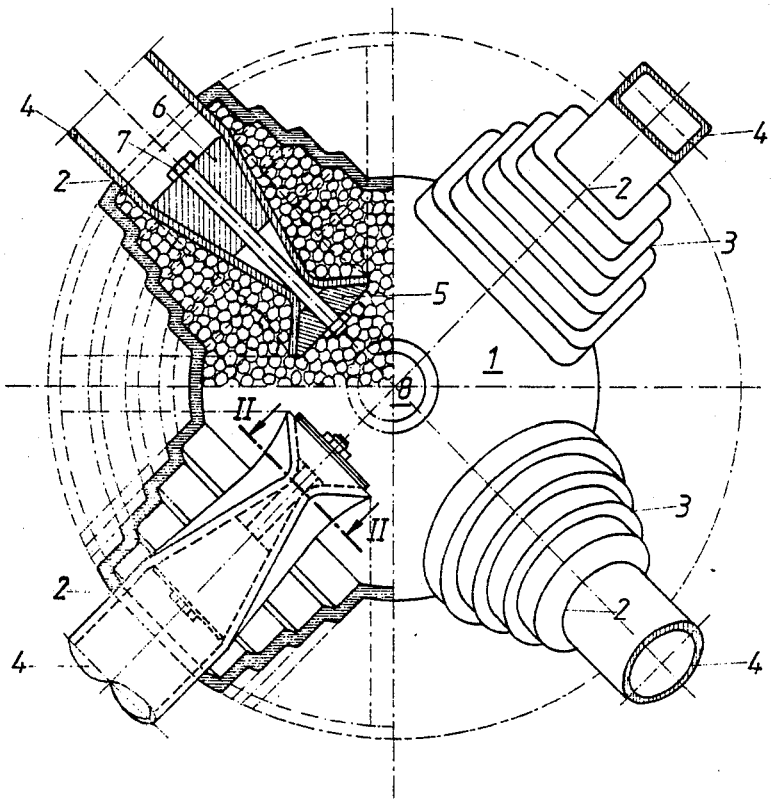
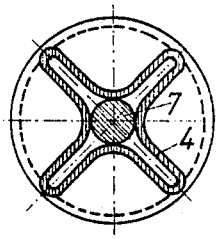
Fig.2
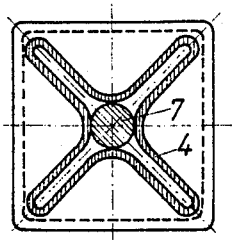
Fig.3
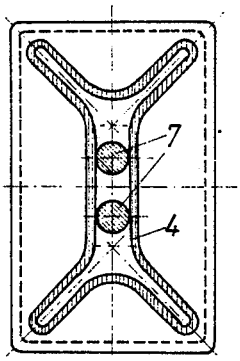
Fig.4

JOINT CONNECTION FOR FRAME STRUCTURES

BACKGROUND OF THE INVENTION

The invention relates to a joint for frame structures with more than two bars connected in one joint. More particularly, the invention relates to a joint wherein the more than two bars are designed as tubes which are inserted through apertures in a metal casing adapted to be filled with a hardening grout, and the end portions of the bars, terminating in the metal casing, have portions which form a positive connection and which are crimped or necked down.

In the type of joint exemplified in British Pat. No. 271,709, the necked-down end portion constitutes a weak point in each bar or tube. The bars must have appropriately large dimensions in order to be able to absorb large tensile forces or bending moments. Relatively large tensile forces acting on the bars can deform the end portion of the bar whereby the positive connection with the grout is lost. Basically, the same problems also exist in the joint taught by Austrian Pat. No. 339,094.

SUMMARY OF THE INVENTION

The major object of the invention is to provide a joint for framed structures, particularly of steel constructions, which joint has relatively great strength. The load carrying capacity, especially the resistance to tensile forces, in the critical, necked-down end portion is to be no less than in an unweakened tube cross section. Deformations of the end portion and loosening of the positive connection with the grout are to be prevented.

This object is achieved in a joint of the type mentioned above by pretensioning, in the necked-down end portion of the bars, two inserted members in each bar. The inserted members each have tapering sections which are oriented in opposition to face each other within the bars. The members are arranged in in flatwise abutting engagement in opposite sections of the neck by adapting the neck to the shape of the inserted members. External forces acting on the bars can not deform the end portion of a bar thusly supported internally. An absolutely reliable positive connection with the grout is achieved. The inserted members constitute the backing tool remaining in the end portions of the bars during the production of the neck by means of one or more pressing tools; the neck is appropriately adapted to the shape of the inserted members.

In a preferred embodiment of the invention, the inserted members are urged toward each other by a tensioning member having adjustable length and being located in the tube axis. A slight elastic recovery of the deformed tube wall occurring during production of the neck produces a gap between the inserted members and the inside of the necked-down or crimped tube wall. By shortening the length of the tensioning member linking the two inserted members in the tube axis, e.g., by tightening the bolt or several such bolts functioning as the tensioning member or members, this gap can be closed and the positive connection with the grout can be made still more secure. Moreover, some of the force on the bar is absorbed by the tensioning member, and in this way, the load on the tube cross section in the important zone of the end portion is reduced.

BRIEF DESCRIPTION OF THE DRAWINGS

The invention will be explained in greater detail with reference to the drawings in which the parts bear like reference numerals. In the drawings:

FIG. 1 is an elevated front view in partial cross-section along the axis of one of the bars in the joint according to the present invention; and FIGS. 2 through 4 are cross-sectional views taken along line II—II of FIG. 1 of various embodiments of the joint of the present invention.

DETAILED DESCRIPTION OF THE PREFERRED EMBODIMENTS

A joint according to a preferred embodiment of the present invention is comprised of a metal casing 1 having a convex central portion substantially in the form of a flattened sphere. Protruding stellatedly from the central portion, projections 3 taper in stepwise fashion from apertures 2 in the metal casing. As shown in FIG. 1, particularly the left half thereof, projections 3 are formed from a series of hollow portions which decrease in cross-section with increasing distance from casing 1 so as to taper in steplike fashion from the casing.

In the right portion of FIG. 1 (not shown in cross section) is indicated an aperture 2 receiving a bar 4 in the form of a tube with a square cross section and another aperture 2 receiving a bar 4 in the form of a tube with a circular cross section. One advantage of the joint connection according to the invention is that the bars 4 are not required to have the same cross section. For example, diagonal members could be made thinner than chord members.

In the left portion of FIG. 1 are shown, linked by the joint, two bars, the axis of which are located in the plane of the drawing. A filling filling material in the metal casing 1 is shown in the upper part of the left half of FIG. 1. This filling material is not shown in the lower part of the left half of FIG. 1 and also the end portion of bar 4 is not shown in cross section therein.

It is apparent that bars 4 have a necked down end portion that forms a positive connection in the metal casing. It can be seen from the cross-sectional views of the necked-down end portions of bars 4 in FIGS. 2 to 4 that the neck is formed by folding the tube wall without thinning or altering its cross-sectional area.

In each necked-down end portion of bars 4, two inserted members 5 and 6 are mounted in of the neck and oriented therein with their tapering portions facing in opposition. The neck is adapted to the shape of the inserted members 5, 6. By means of a tensioning member 7 in the form of a high-strength bolt or a plurality of such bolts (FIG. 4) located in the tube axis, the two inserted members 5, 6 are urged together longitudinally within the end portion of each bar 4 such that the members 5, 6 come into flatwise abutting engagement with the inside walls of the tubes in opposite sections of the neck.

On the top side of the metal casing 1, a filling aperture 8 is provided for filling the casing with hardening grout.

We claim:

1. A joint for frame structures, said joint comprising at least three tubular members and a metal casing having apertures therein for receiving an end portion of each of said tubular members wherein:

said received end portion of each of said tubular members terminates in a necked-down portion having a first tapering inner wall portion in opposing spaced-apart relation to a second tapering inner wall portion therein;

said metal casing is adapted to be filled with a hardenable grout;

a pair of elements having tapering sections are positioned in spaced-apart relation within said necked-down portion of each of tubular members with their tapering sections facing in opposition; and prestressing means are located in each of said necked-down portions for urging one of said elements against said first tapering inner wall portion and the other of said elements against said second tapering inner wall portion in flatwise, abutting engagement therewith to prestress said necked-down end portion;

each of said prestressing means including adjustable means for urging said opposing elements toward each other in each of said necked-down portions, said adjustable means being aligned with the longitudinal axis of each tubular member.

2. A joint as claimed in claim 1, wherein each said necked-down portion has the same cross-sectional area as non-necked-down portions of each said tubular member.

3. Means for reinforcing a necked-down end portion of a tubular member for use in a joint connecting at least three such tubular members, the necked-down portion having first and second oppositely oriented tapering sections each having parallel side wall portions and inclining wall portions connecting the side wall portions, said means comprising:

a first element having outwardly extending, tapering portions adapted to be received between associated side wall portions and to abut against an associated inclining wall portion in the first tapering section of the necked-down end portion of the tubular member, the tapering portions of the first element facing in a given direction therein;

a second element having outwardly extending, tapering portions adapted to be received between associated side wall portions and to abut against an associated inclining wall portion in the second tapering section of the necked-down end portion of the tubular member, the tapering section of the second element facing in an opposite direction and being spaced-apart from the first element therein;

a third element for connecting said first and second elements, the third element being adapted to urge said first and second elements toward each other under tension against their associated inclining wall portions.

* * * * *